US005499923A

United States Patent [19]

Archibald et al.

[11] Patent Number: 5,499,923

[45] Date of Patent: Mar. 19, 1996

[54] COMMUNICATION CARD WITH EXTENDIBLE, ROTATABLE COUPLING

[75] Inventors: James L. Archibald, Clearwater, Fla.; Donald R. Laturell, Allentown, Pa.

[73] Assignee: AT&T Corp., Murray Hill, N.J.

[21] Appl. No.: 336,633

[22] Filed: Nov. 9, 1994

[51] Int. Cl.[6] ..... H01R 9/09; H01R 39/08

[52] U.S. Cl. ..... 439/26; 439/76.1; 439/928.1

[58] Field of Search ..... 439/13, 20, 21, 439/23–26, 32, 76.1, 928.1

[56] References Cited

U.S. PATENT DOCUMENTS 5,183,404 2/1993 Aldous et al. ..... 439/55

OTHER PUBLICATIONS

Byte article, "PCMCIA: Past, Present, and Promise", Nov. 1994, pp. 65, 66, 68, 70 & 72.

*Primary Examiner*—Gary F. Paumen
*Attorney, Agent, or Firm*—David L. Smith; M. J. Urbano

[57] ABSTRACT

A communication card includes a housing and a shank rotatably mounted thereto. The shank defines an axis along its length around which the shank can rotate. A connector is mounted on the shank. The shank and connector are extendable beyond an edge of the housing to an extended position. In the extended position, the connector and shank are rotatable about the shank axis.

27 Claims, 4 Drawing Sheets

COMMUNICATION CARD WITH EXTENDIBLE, ROTATABLE COUPLING

TECHNICAL FIELD

This invention relates generally to communication cards usable in computers and particularly to such communication cards having an extendible, rotatable coupling.

BACKGROUND OF THE INVENTION

Computers, particularly downsized computers such as portable computers, notebook computers, and notepad computers have card slots for insertion of cards of various function capabilities. One of the functions a card can provide is communications. Communications cards may provide a modem for local area network (LAN) function. Communications cards are often coupled to a cellular telephone or to a telephone line by a receptacle connector or telephone jack, known in the industry as an RJ-11 connector.

U.S. Pat. No. 5,183,404 discloses a modem card with a connector that slides out of the card to be coupled to a plug connector terminated to a telephone line. In the extended position, the connector is retained in the plane of the card. The telephone jack is inserted into the connector from a direction perpendicular to the sliding motion. With the card inserted into a computer and the connector fully extended, the telephone jack in its inserted position extends beyond the card on one side, and the telephone wire extends beyond the card on the other side. When multiple cards are inserted into adjacent slots, this design can be a problem. Structural features that extend beyond the profile of a first card can interfere with insertion and removal of a second card positioned in an adjacent slot. In addition, the telephone wire being pulled by gravity creates an undesirable a moment that is transferred to the card.

SUMMARY OF THE INVENTION

A communication card includes a housing and a shank rotatably mounted thereto. The shank defines an axis along its length around which the shank can rotate. A connector is mounted on the shank. The shank and connector are extendable beyond an edge of the housing to an extended position. In the extended position, the connector and shank are rotatable about the shank axis.

DETAILED DESCRIPTION

Figure 1:
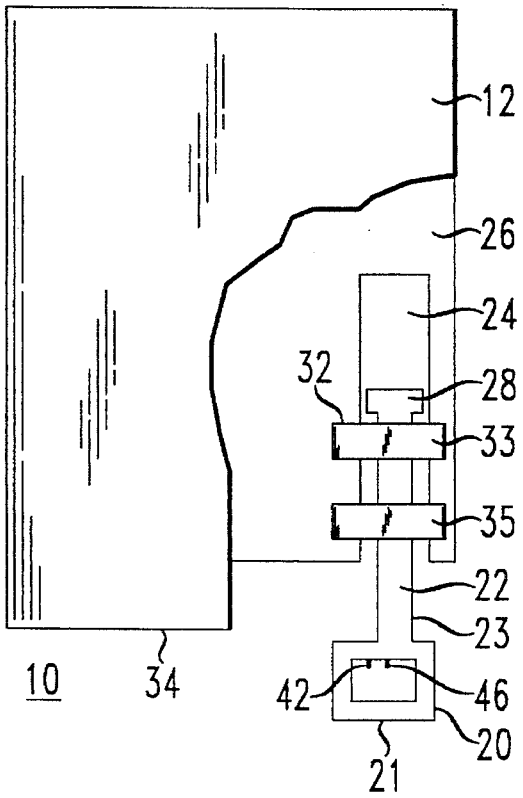
FIG. 1 is a top view of a communication card including a connector in accordance with an illustrative embodiment of the invention.

FIG. 1 shows a top view of a communication card 10, with a portion of its cover 12 cut away, including a connector 20, in accordance with an illustrative embodiment of the invention. The connector is secured to communication card 10 and is movable from a retracted position in which the connector is in the plane of the communication card to an extended position. In the extended position the connector is rotatable out of the plane of the communication card.

Figure 2:
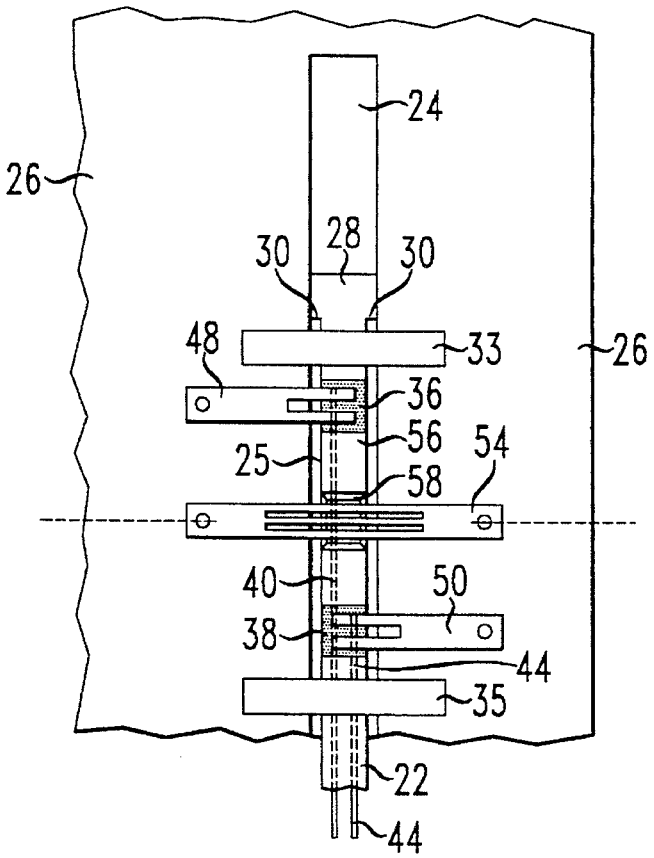
FIG. 2 is a top view of a portion of the shank, supporting a connector.
Figure 4:
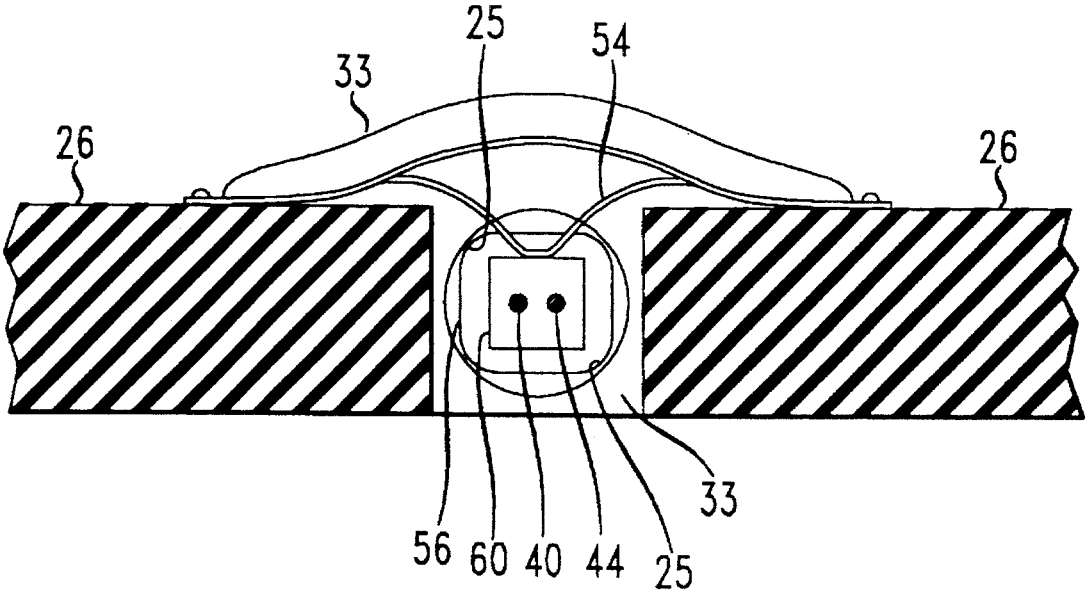
FIG. 4 is a cross-sectional view of the shank showing the detent spring member.

Connector 20 is secured to the outer end 23 of a shank 22 and may be integrally molded with shank 22. Shank 22 may have a cross section that is a regular polygon, such as a square. Other shapes are suitable. The polygonal cross-section may have rounded vertices 25. The rounded vertices cooperate with pillow blocks 33 and 35, as shown in FIGS. 1, 2, and 4, to support shank 22. Pillow blocks 33 and 35 are mounted on circuit board 26. Shank 22 can both rotate about an axis and slide within pillow blocks 33 and 35. When the axis of rotation of shank 22 is not aligned with a centerline of connector 20, upon rotation of the connector and shank the connector rotates out of the plane of communication card 20. Slot 24 in circuit board 26 accommodates shank 22 sliding within pillow blocks 33 and 35. Shank 22 may have a widened trailing end 28 with forward edge 30. Edge 30 engages a stop 32, such as the surface of pillow block 33, to limit the outward movement of connector 20 and shank 22, and thereby limit the distance connector 20 extends in the extended position from edge 34 of communication card 10. In the retracted position, edge 21 of connector 20 may be substantially flush with edge 34, although the invention is not limited thereto.

Figure 3:
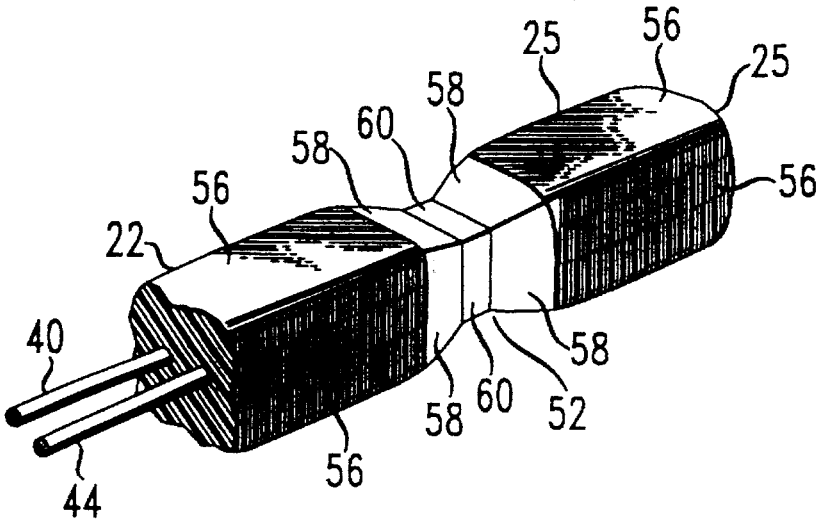
FIG. 3 is an isometric view of a portion of the shank showing a reduced cross-section region.

With reference also to FIG. 2, forward of widened trailing end 28 on shank 22 are spaced contact regions 36 and 38. Contact regions 36 and 38 circumscribe the exterior surface of shank 22. Conductor 40 is electrically coupled with contact region 36, extends along shank 22 to connector 20, and forms contact 42 in connector 20. Similarly, conductor 44 is electrically coupled with contact region 38, extends along shank 22 to connector 20, and forms contact 46 in connector 20. Conductors 40 and 42 may be embedded within shank 22, as shown in FIGS. 2, 3, and 4.

Contacts 48 and 50 are mounted on circuit board 26, electrically commoned with traces thereon, and are spaced to correspond with spaced contact regions 36 and 38. Contacts 48 and 50 conduct signals between traces (not shown) on circuit board 26 and contact regions 36 and 38. Contacts 48 and 50 preferably are bifurcated to reduce the resistance in the signal conduction path and to better assure that contact 48 remains physically engaged with contact region 36 and contact 50 remains physically engaged with contact region 38. Maintaining contact engagement is particularly important as shank 22 is rotated during operation of communication card 10, such as transmitting or receiving information.

Along shank 22, shown in the illustrative embodiment between contact regions 48 and 50, is a circumferential recess 52 in shank 22. Recess 52, best seen in the perspective view of FIG. 2, extends into shank 22 from all sides 56 of the polygonal shape. A detent spring 54, shown in FIGS. 2 and 4, slides along one of the polygonal surfaces 56 of shank 22 as connector 20 is moved from the retracted position to the extended position where detent spring 54 is received in recess 52. When received in recess 52, detent spring 54 provides a shank extension detent function to maintain the shank in the extended position. To facilitate spring 54 sliding into recess 52 upon connector 20 being moved into the extended position, and spring 54 sliding out of recess 52 upon connector 20 being moved from the extended position, a transition surface 58 on shank 22 tapers from each surface 56 to a respective surface 60. Surfaces 60, also form a regular polygon and in cooperation with detent spring 54 provide a rotational detent function to maintain shank 22, and hence connector 20, in a user determined rotational or angular orientation with connector 20 in the extended position. Detent spring 54 may be mounted on circuit board 26 as shown in FIG. 4.

Figure 5:
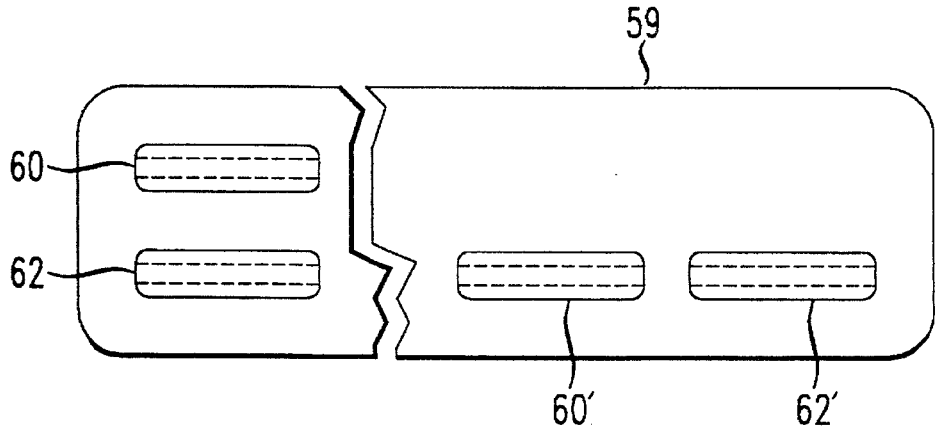
FIG. 5 is a view of a computer showing dual vertical card slots on the left and dual horizontal card slots on the right.

FIG. 5 shows a side view of a computer 59 having dual card slots 60 and 62. The left side of FIG. 5 shows the dual card slots 60 and 62 stacked vertically, while the right side of FIG. 5 shows dual card slots 60' and 62' positioned side-by-side.

Figure 6:
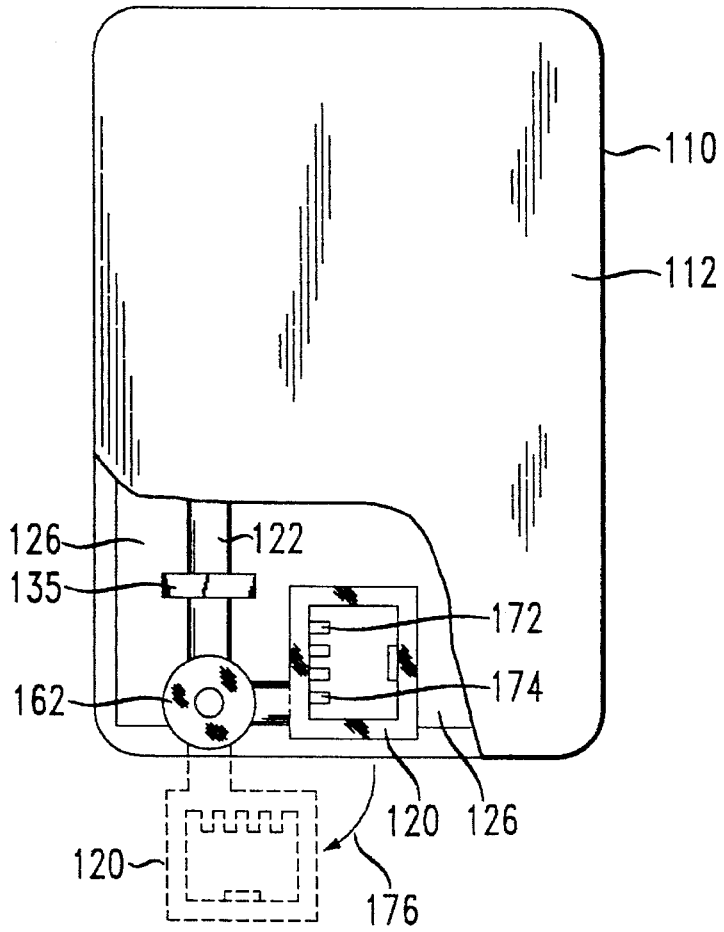
FIG. 6 is a communication card including a connector in accordance with an alternate illustrative embodiment of the invention.
Figure 7:
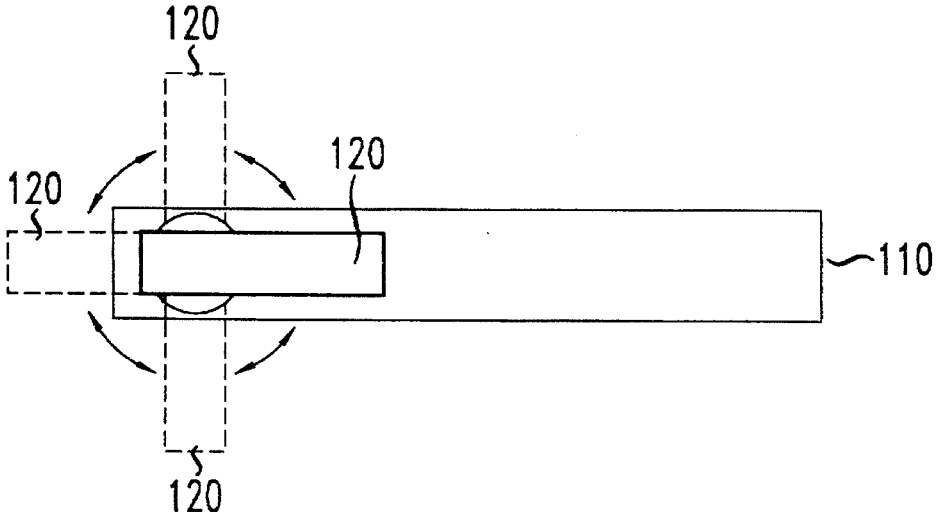
FIG. 7 is an end view of an alternate illustrative embodiment showing the connector in various rotated positions in tandem.
Figure 8:
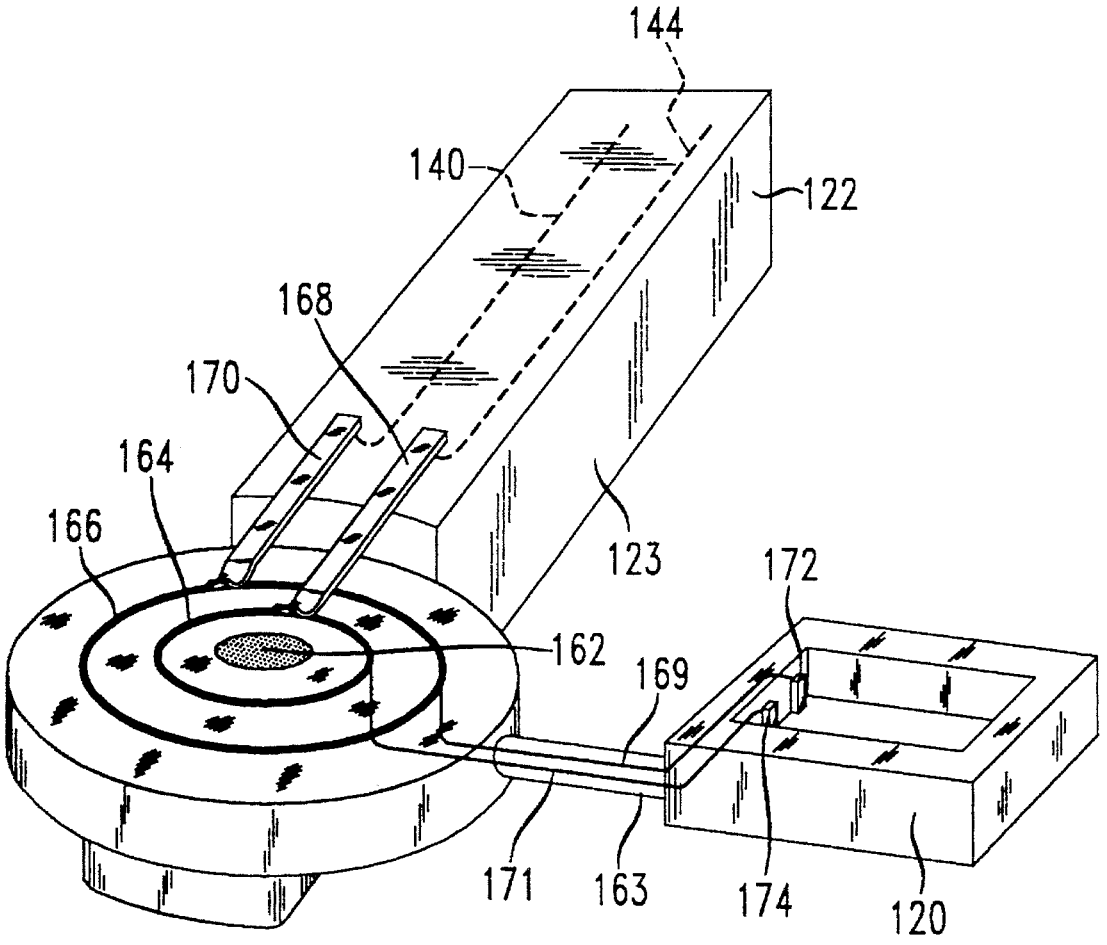
FIG. 8 is a view of concentric contact areas in the pivot region of the alternate illustrative embodiment.

An alternative illustrative embodiment of the invention is shown in FIGS. 6 through 8. As shown in FIG. 6, communication card 110 has cover 112 partially cut away. Shank 122, similar to shank 22 described above, is mounted on circuit board 126 by pillow block 135 which permits shank 122 to rotate about its axis. Connector 120 is shown pivotally mounted on the end 123 of shank 122. In phantom, connector 120 is shown rotated outwardly from the retracted position to an extended position. In the extended position connector 120 can be rotated. With the axis of shank 122 not aligned with a centerline of connector 120, upon rotation of the connector and shank the connector rotates out of the plane of communication card 110.

FIG. 7 shows connector 120 in the extended position in the plane of card 110 and rotated out of the plane of communication card 110 to other orientations in phantom.

As best seen in FIG. 8, shank 122 has a pivot arm 163 pivotally mounted on the outer end 123 of shank 122. A first end of pivot arm 163 is secured to shank 122 by pivot 162. Connector 120 is integral with the other end of pivot arm 163. To facilitate rotating from the retracted position to the, extended position, surrounding pivot 162 are concentric annular contact surfaces 164 and 166. Contacts 168 and 170 are mounted on shank 122, commoned with respective embedded conductors 140 and 144, and respectively engage annular contact surfaces 164 and 166 to conduct signals between traces on circuit board 26 and contacts in connector 120. Annular contact surfaces 164 and 166 are electrically commoned with respective contacts 172 and 174 in connector 120, such as through embedded conductors 169 and 171.

In operation, connector 120 is rotated out of communication card 110 to an extended position, as shown by arrow 176 in FIG. 6. Annular contact surfaces 164 and 166 are engaged by contacts 168 and 170 to maintain contacts 172 and 174 electrically commoned with traces on circuit board 126. In the extended position, connector 120 can be rotated out of the plane of communication card 110, to any angular orientation desired by the user. Angular orientation detents can be provided for shank 122 in a manner described for shank 22.

While the illustrative embodiment has been disclosed as having contacts slidably engaging contact regions or contact surfaces to maintain traces on a circuit board electrically commoned with contacts in a connector, other techniques for achieving the electrical commoning can be used. Similarly, although the illustrative embodiment has been disclosed as having concentric annular surfaces engaged by contacts to electrically common conductors in the shank with conductors in a pivot arm, other techniques for achieving the electrical commoning can be used. In addition, while the shank has been disclosed as having a regular polygonal shape, other shapes such as a cylindrical shank including a detent region would suffice. Detent surfaces similar to surfaces 60 could be provided within the detent region to provide an angular orientation detent.

We claim:

1. A communication card adapted to be inserted into a slot in a computer, comprising:

a housing;

a shank rotatably mounted to the housing, the shank defining an axis along its length around which the shank can rotate; and an electrical mounted on the shank, the shank and connector being extendable beyond an edge of the housing to an extended position, in the extended position the connector and shank being rotatable relative to the housing about the shank axis.

2. A communication card as recited in claim 1, wherein the shank axis is not aligned with a center line of the connector, whereby upon rotation the connector can rotate out of the plane of the housing.

3. The communication card as recited in claim 1, wherein the shank further comprises a plurality of shank surfaces such that a cross-section of the shank is a polygon.

4. The communication card as recited in claim 3, wherein edges of the polygon form vertices, the vertices being rounded to smoothly transition from one shank surface to an adjacent shank surface.

5. A communication card as recited in claim 3, further comprising a recess in the shank; and a spring member mounted to the housing, the spring member extendable into the recess to provide a detent function upon the connector being moved to an extended position.

6. A communication card as recited in claim 5, wherein the recess extends into each of the plurality of shank surfaces to define indentation surfaces, a cross-section of the recess forming a polygon.

7. A communication card as recited in claim 6, wherein the recess has a plurality of indentation surfaces corresponding in number to the plurality of shank surfaces such that the spring member, when received in the recess, provides a rotational detent function through its cooperation with the indentation surfaces that tends to retain the shank in a user determined angular orientation.

8. A communication card as recited in claim 1, further comprising:

first and second contact regions circumscribing the shank at spaced locations; and first and second conductors to couple contacts in the connector to respective said contact regions.

9. A communication card as recited in claim 8, wherein the conductors are embedded in the shank.

10. A communication card as recited in claim 1, wherein the connector is extendable beyond an edge of the housing by a slidable mount.

11. A communication card as recited in claim 1, wherein the connector is extendable beyond an edge of the housing by a pivotal mount.

12. A communication card adapted to be inserted into a slot in a computer, comprising:

a housing;

a shank slidably mounted to the housing, the shank defining an axis along its length, the shank rotatable around the axis; and an electrical secured to an end of the shank, the connector coupled to a circuit in the housing, the shank and connector slidable from a retracted position to an extended position, in the extended position the connector and shank being rotatable relative to the housing about the axis of the shank.

13. A communication card as recited in claim 12, wherein the shank axis is not aligned with a center line of the connector, whereby upon rotation the connector can rotate out of the plane of the housing.

14. The communication card as recited in claim 12, wherein the shank further comprises a plurality of shank surfaces such that a cross-section of the shank is a polygon.

15. A communication card as recited in claim 13, further comprising a recess along the shank; and a spring member mounted to the housing, the spring member extendable into the recess to provide a detent function upon the connector being moved to an extended position.

16. A communication card as recited in claim 12, further comprising:

first and second contact regions circumscribing the shank at spaced locations; and first and second conductors to couple contacts in the connector to respective said contact regions.

17. A communication card as recited in claim 16, wherein the conductors are embedded in the shank.

18. A communication card as recited in claim 13, further comprising:

a circuit board in the housing, the circuit board having traces thereon; and a contact having first and second ends, the first end coupled to a trace on the circuit board, the second end extended to engage a contact region on the shank.

19. A communication card as recited in claim 18, wherein the second end of the contact is bifurcated.

20. A communication card adapted to be inserted into a slot in a computer, comprising:

a housing;

a shank mounted to the housing, the shank defining an axis along its length, the shank rotatable around the axis; and a pivot arm having first and second ends, the first end pivotally secured to an end of the shank; and an electrical secured to the second end of the pivot arm, the connector coupled to a circuit in the housing, the connector moveable from a retracted position to an extended position by pivotal movement of the pivot arm, in the extended position the connector and shank being rotatable relative to the housing about the axis of the shank.

21. A communication card as recited in claim 20, wherein the shank axis is not aligned with a center line of the connector, whereby upon rotation the connector can rotate out of the plane of the housing.

22. The communication card as recited in claim 20, wherein the shank further comprises a plurality of shank surfaces such that a cross-section of the shank is a polygon.

23. A communication card as recited in claim 22, further comprising a recess in the shank; and a spring member mounted to the housing, the spring member extendable into the recess to provide a detent function upon the connector being moved to an extended position.

24. A communication card as recited in claim 20, further comprising:

first and second contact regions circumscribing the shank at spaced locations; and first and second conductors to couple contacts in the connector to respective said contact regions.

25. A communication card as recited in claim 24, wherein the conductors are embedded in the shank.

26. A communication card as recited in claim 20, further comprising:

a circuit board in the housing, the circuit board having traces thereon; and a contact having first and second ends, the first end coupled to a trace on the circuit board, the second extended to engage the shank, whereby the second end of the contact will engage one of the first or second contact regions when the shank is in the extended position.

27. A communication card as recited in claim 26 wherein the second end of the contact is bifurcated.

* * * * *